US012559818B2

(12) United States Patent
Sceats et al.

(10) Patent No.: US 12,559,818 B2
(45) Date of Patent: Feb. 24, 2026

(54) METHOD FOR THE PYROPROCESSING OF POWDERS

(71) Applicant: CALIX LTD, Pymble (AU)

(72) Inventors: Mark Geoffrey Sceats, Pymble (AU); Adam Vincent, Pymble (AU); Andrew Okely, Pymble (AU); Matthew Boot-Handford, Pymble (AU); Dabin Wang, Pymble (AU); Lakshmi Vazhapully, Pymble (AU); Terrance Banks, Pymble (AU)

(73) Assignee: CALIX LTD

( * ) Notice: Subject to any disclaimer, the term of this patent is extended or adjusted under 35 U.S.C. 154(b) by 403 days.

(21) Appl. No.: 18/041,094

(22) PCT Filed: Jul. 26, 2021

(86) PCT No.: PCT/AU2021/050807

§ 371 (c)(1),
(2) Date: Feb. 9, 2023

(87) PCT Pub. No.: WO2022/032327

PCT Pub. Date: Feb. 17, 2022

(65) Prior Publication Data

US 2024/0018622 A1 Jan. 18, 2024

(30) Foreign Application Priority Data

Aug. 12, 2020 (AU) ..... 2020902858

(51) Int. Cl.
*C22B 1/02* (2006.01)
*C22B 1/26* (2006.01)
*C22B 26/12* (2006.01)

(52) U.S. Cl.
CPC ..... *C22B 1/02* (2013.01); *C22B 1/26* (2013.01); *C22B 26/12* (2013.01)

(58) Field of Classification Search
CPC .. C22B 1/02; C22B 1/26; C22B 26/12; C22B 1/10; B01J 8/12; C01B 33/26;
(Continued)

(56) References Cited

FOREIGN PATENT DOCUMENTS

| | | |
|---|---|---|
| AU | 2014 354 559 | 6/2016 |
| AU | 2018 207 579 | 5/2019 |

(Continued)

OTHER PUBLICATIONS

WO-2016032138-A1: Espacenet English machine translation (Year: 2016).*

(Continued)

*Primary Examiner* — Adil A. Siddiqui
(74) *Attorney, Agent, or Firm* — David R. Stevens; Stevens Law Group

(57) ABSTRACT

A method for heating a powder material to induce a crystalline phase change in the grains of the particle comprising the steps of: a. preheating the powder from the high temperature streams generated from cooling the phase changed product; b. injecting the powder into a metal tube; c. controlling the gas composition in the metal tube by injecting a gas into the reactor; d. externally heating the first section of the tube by a first furnace segment system; e. externally heating the second section of the tube by a second furnace segment system; f: quickly quenching the powder product temperature in a cold third segment of the tube; g. collecting the processed powder at the base of the tube in a bed ejecting the powder from the tube; h. cooling the powder in a heat exchanger and using the heat to preheat the powder in step a.

16 Claims, 1 Drawing Sheet

(58) Field of Classification Search
CPC .. F27B 1/005; F27D 11/00; F27D 2009/0089; F27D 13/00; F27D 13/002; F27M 2001/03
See application file for complete search history.

(56) References Cited

FOREIGN PATENT DOCUMENTS

| | | | | |
|---|---|---|---|---|
| AU | 2020 204 263 | | 7/2020 | |
| CN | 103204510 | | 7/2013 | |
| CN | 107739847 | | 2/2018 | |
| WO | 2011/148040 | | 12/2011 | |
| WO | WO-2016032138 | A1 * | 3/2016 | ..... C22B 6/12 |
| WO | 2016/077863 | | 5/2016 | |
| WO | 2016/156671 | | 10/2016 | |
| WO | 2017/157906 | | 9/2017 | |
| WO | 2018/076073 | | 5/2018 | |
| WO | WO-2018076073 | A1 * | 5/2018 | ..... B01J 6/004 |

OTHER PUBLICATIONS

Wietelmann Ulrich et al: "Lithium and Lithium Compounds" In: "Ullmann•s Encyclopedia of Industrial Chemistry", Jan. 1, 2013 (Jan. 1, 2013), Wiley-VCH, Weinheim, XP093235533, ISBN: 978-3-527-30673-2 pp. 1-38, DOI: 10.1002/14356007.a15_393.pub2, * figure 3 *.

Salakjani Nasim KH. et al: "Production of Lithium—A Literature Review Part 1: Pretreatment of Spodumene", Mineral Processing and Extractive Metallurgy Review, vol. 41, No. 5, Jul. 29, 2019 (Jul. 29, 2019), pp. 335-348, XP093245266, us ISSN: 0882-7508, DOI: 10.1080/08827508.2019.1643343.

* cited by examiner

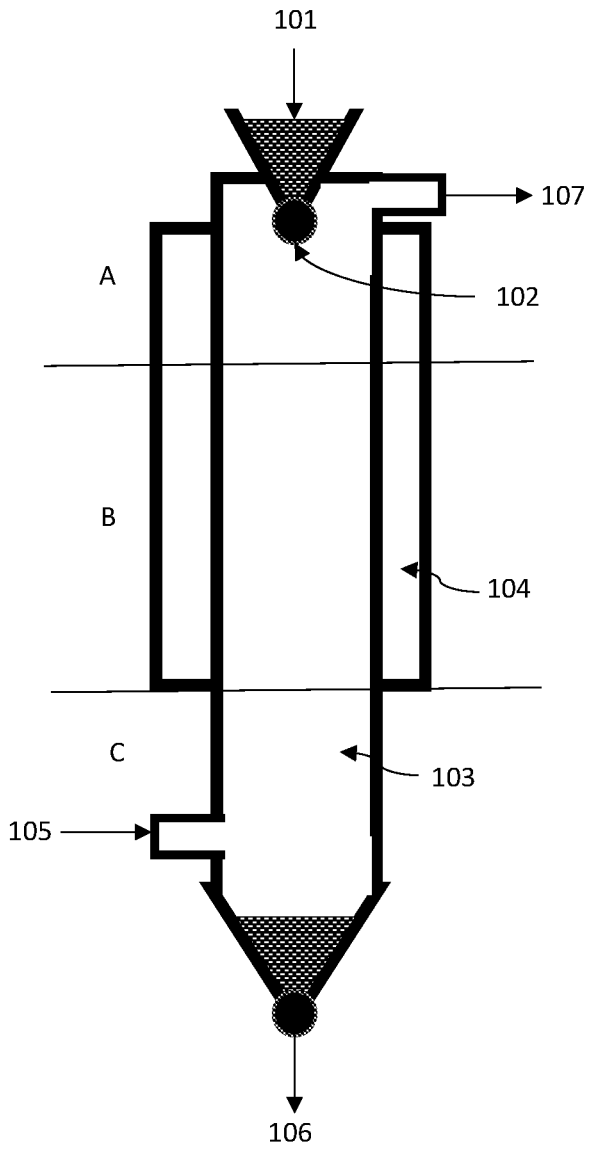
101
107
A
102
B
104
C
103
105
106

METHOD FOR THE PYROPROCESSING OF POWDERS

TECHNICAL FIELD

The present invention relates broadly to a method of pyroprocessing a powder to induce a phase change in the grains of the powder particles, and/or to avoid an undesirable phase change.

The invention is described by using the application for processing the mineral α-spodumene for the extraction of lithium, where the phase change is the conversion of α-spodumene to a mixture of β-spodumene and γ-spodumene to facilitate extraction of lithium by the known arts of hydrometallurgy.

BACKGROUND

In this invention, for the avoidance of doubt, the term "calcination" is limited to a process in which a powder is heated with the primary purpose of inducing a chemical reaction which releases a gaseous product such a steam or $CO_2$; and the term "pyroprocessing" is limited to a process in which a powder is heated with the primary purpose of inducing a phase change; and the term "roasting" is limited to a process in which powders of different materials are heated with the primary purpose of inducing chemical reactions between the particles. It is recognised that a person skilled in the art may use these terms interchangeably.

Pyroprocessing of powders is well established in industry. Most of these processes have been developed using combustion of fossil fuels and mixing the powder into the hot combustion gases. There is a need to replace these fuels by renewable sources of energy, such as biomass and hydrogen, to limit global warming. However, there is also a general need to improve the quality of pyroprocessed materials, and this invention considers a means of pyroprocessing that can be used to improve the product quality by a process in which the powder is not mixed with a combustion gas. Specifically, there is a need to allow processing to occur in a gas which has the most desired reducing, neutral or oxidation potential, which is not generally achievable in a hot combustion gas.

This invention is directed to the pyroprocessing of the mineral α-spodumene to enable the subsequent extraction of lithium, as a specific, but not limited, example which demonstrates the general application of the invention.

Lithium is required at industrial scale for the production of lithium batteries, and the growth of that market is increasing at a rate of about 18% pa to meet the needs for storage of electric power, particularly renewable power, for many markets which now including batteries for electric vehicles, and stationary applications such as load balancing electrical grids to accommodate variations from solar and wind power. This growth of battery markets is to be sustained by ongoing reductions in the cost of input materials, including the cost of lithium carbonate and lithium hydroxide, which are generally used as the source of lithium by lithium battery manufacturers. There are several sources of lithium that are used, namely from salar brines in which the lithium has been concentrated over long periods of time, and from a range of minerals, including spodumene, eucryptite, petalite, bikitaite as described by Dessemond et.al in "Spodumene: The Lithium Market, Resources and Processes" Minerals, 9, 334 (2019). In recent years, the costs of extraction from brines has become uncompetitive compared to mineral extraction methods. Of the lithium containing minerals, spodumene, in the form of α-spodumene, has the highest lithium content, of 8 wt % when pure, and there are abundant mineral sources of α-spodumene with purities ranging from about 2-6 wt % that can be exploited cost effectively. The extraction process generally involve a mix of mineral beneficiation, pyroprocessing, acid roasting, and hydrometallurgical extraction steps. The energy and capital costs for these extraction processes are high, and there is a need to reduce those costs by improving these steps to meet the growing demand and cost reductions.

The mineral α-spodumene, $LiAl(SiO_3)_2$ has a crystal structure in which the aluminium ion is tightly bound to 6 oxygen atoms so that the density is very high, about 3.15 $g/cm^3$. This mineral is too dense for efficient direct hydrometallurgical extraction of lithium, and in this dense phase the migration of the lithium ion is too slow, and extensive grinding processes to reduce this time are too expensive. The phase diagram of spodumene is not well established, however it would appear the α-β phase transition commences at temperatures as low as 520° C., but is very slow. However, by heating to about 1000° C. the α-spodumene is converted to a mixture of β-spodumene and γ-spodumene. Both these structures are characterised by aluminium ions that are bound to 4 oxygen atoms, and the weaker bonding is such that the density of the products is low, about 2.37 $gm/cm^3$ and hydrometallurgical extraction processes can take place quickly in particles that are in the range of 50-300 microns. There have been extensive studies of this process, as described in the review "Phase transformation mechanism of spodumene during its calcination" by Abdullah et. al. in Minerals Engineering, 140, 1058883, 2019. The process is now understood to occur through several mechanisms depending on the grind size. In the early literature, it was assumed that the α-spodumene converted directly to β-spodumene, and the γ-spodumene, a known meta-stable phase was not considered. Nevertheless, studies have shown that lithium can be extracted from both β-spodumene and γ-spodumene without significant differences. The work of Moore et.al, "In situ synchrotron XRD analysis of the kinetics of spodumene phase transitions", *Phy s. Chem. Chem. Phys.*, 20, 10753 (2018) conducted in air, showed that at high temperatures, in the range of 896-940° C. α-spodumene was converted to a mixture of β-spodumene and γ-spodumene phases with a fraction of γ which was about 35%. They observed a slow decrease of the γ-spodumene to β-spodumene at 981° C. over 240 minutes in muffle furnace tests in air. The particle size and impurity dependence of the onset of pyroprocessing may be related to the grain size of the ground particles, where the phase change propagates from the grain surfaces, and/or the lowering of the phase change temperature from substitutional impurities within the grains or impurities at the grain boundaries.

The process of α-spodumene transformation was patented by Ellestad et. al. in U.S. Pat. No. 2,516,109 in 1948, and described the heating process for granules of the order of 0.5-2.5 mm as one which required heating to over 1000° C., within the heating duration of about 30 minutes. The temperature was specified to be below the decomposition temperature of 1418° C., where the silica is liberated as a molten material. By control of temperature, 100% extraction using a hydrothermal process was described. The pyroprocessing methods were described as a muffle furnace (externally heated with a fixed powder bed), a rotary furnace, and a direct fired furnace with combustion. The long residence time and thermal losses from such devices is very high, so that there is a general need to reduce the residence time to lower costs.

The patent WO 2011/148040 describes the advantages of using a fluidised bed for calcination of α-spodumene particles with a size of 20-1000 microns in an oxidative gas at 800-1000° C. where oxygen was required for fuel combustion in the pyroprocessor to provide the heat; the residence time was about 15-60 minutes; and the heat in the hot gas and solids exhausted from the pyroprocessor is used to dry and preheat the solid feedstock; and the need to limit the formation of molten phases to less than 15% was specified. To a person skilled in the art, the reference to restricting the molten phases is a reference to the melting of silica, a decomposition product of spodumene, over the product surface, which inhibits the subsequent extraction efficiency.

Colour changes are generally induced in minerals pyroprocessed in the oxidative conditions of a combustion gas, associated with the oxidation of multivalent impurities such are iron, chromium, copper, nickel, manganese, or crystal defects. In certain pyroprocessing processes there is a need to control the colour of the processed solids, and it would be preferable to process the material in a gas where the redox potential of the gas can be controlled to produce the desired oxidation state.

In another process, first described by G. D, White and T. N. McVay "Some aspects of the recovery of lithium from spodumenes", Oak Ridge National Laboratory, 1958, a process is considered in which the silica is extracted by roasting pellets of α-spodumene and limestone $CaCO_3$ such that calcium silicates are formed, and the lithium forms water-soluble $LiAlO_2$. This process has recently been carried out in a muffle furnace using particles of about 100 microns at 1050° C. for 30 minutes by Braga et.al "Alkaline process for extracting lithium from Spodumene", 11$^{th}$ International Seminar on Process Hydrometallurgy—Hydroprocess 2019, Santiago, Chile, (2019). This roasting process includes the calcination of limestone to lime, and has not been used commercially. It is noted that the subsequent processing of the β-spodumene and γ-spodumene, with lime or sodium hydroxide is a known art to liberate the lithium from those materials.

As described above, the primary motivation for the pyroprocessing of α-spodumene is to open up the particles by converting the material to the low density 0-spodumene and γ-spodumene phases. It is well established that the product made from this process is porous and friable, as a result of the large density change. As a result, the product is susceptible to decrepitation in the pyroprocessor. In commercial practice, the pyroprocessing of α-spodumene is carried out using pyroprocessors that provide the heat by mixing the particles with a hot combustion gas. These are rotary kilns, fluidised beds or suspension cyclone flash calciners, each of which is a known art. It would be appreciated by a person skilled in the art that each of these pyroprocessors carries out the process under conditions which induce decrepitation. In rotary kilns this occurs by the need to agitate the moving bed by rotation of the kiln and the tilt of the kiln to allow the bed to absorb the heat from a flame. In fluidised beds the high density of the bed and the high particle collision frequency leads to attrition, and this is very high for friable materials. In suspension cyclone flash calciners, the high gas velocity induces collisions throughout the process which induces decrepitation. The result is that the product quality is poor, and difficult to control because the fines and the larger particles can have different degrees of calcination. The different residence times of the fines and the larger particles is such that a significant fraction of the product may be overcooked so that silica from the fusion processes is observed. In all these examples, expensive filter systems are required the separate the fines from the combustion gas streams. In all these systems the powder is processed in a combustion gas, which is an oxidising environment. In fluidised beds and rotary kilns, the residence time is sufficiently long that impurities, such as silica can melt, or form eutectic phases, which inhibit the desired phase changes. There is a need for a pyroprocessor which does not induce decrepitation of the friable β-spodumene and γ-spodumene material, There is a need for a flash pyroprocessor to inhibits the formation of silica eutectic phases, which are known to inhibit extraction.

The grinding of the α-spodumene is optimised to enable separation of the α-spodumene particles from impurities. Due to the similarity of the physical-chemical properties of α-spodumene with the gangue minerals such as quartz, feldspar, mica, muscovite and other aluminosilicates, this is often a challenging task. A floatation separation efficiency of 90% has been reported by Filipov et. al. in "Spodumene Floatation Mechanism" Minerals, 9, 2019, 372 using sodium oleate as the surfactant, with NaOH as a pH regulator and $CaCl_2$) as an activator, with grind size reported to be in the range of 40-150 microns. Reports on other floatation processes suggest that a particle size distribution with a $d_{80}$ of 200 microns can be used for example in the process described by L. Filipov et.al in "Spodumene Floatation Processes", Minerals, 9, 372 (2019), or about 45 microns in J. Tian et. al. "A novel approach for flotation recovery of spodumene, mica and feldspar from a lithium pegmatite ore", J. Cleaner Production, 174, 625 (2018). It would be evident to a person skilled in the art that (a) the preferred grinding process is dependent on the mineral impurities to be separated, and (b) it is preferable that the calcination process should be capable of processing the powders with a particle size distribution that is the same as derived from such an optimised flotation separation efficiency. It is apparent from the references above that the calcination process should be capable of processing particles in the range of 40 to 200 microns. It would be apparent to a person skilled in the art that this range of particle sizes is too small to be readily used by rotary kilns and fluidised bed pyroprocessors because such particles are entrained in the combustion gas, notwithstanding decrepitation. Suspension cyclone flash pyroprocessors are appropriate for such particles, but suffer from decrepitation issues. There is a need for a pyroprocessor that can process particles in the range of 40-200 microns with minimal decrepitation.

The hydrometallurgical process for extraction of the lithium is inhibited if the particles are covered by a coating of fused materials, particularly silica from the spodumene materials which occurs not only on the external surfaces of the particles, but more importantly on the surfaces of the pores of the particle. This limitation is disclosed in the prior art, and is known by persons skilled in the art. The phase transition temperature, of about 1000° C. is above the softening temperature of silica. The rotary kilns and the suspension cyclone flash pyroprocessors use flames from combustion processes to heat the particles. As previously described, the enthalpy of the phase change is very low, so the temperature of the particle continues to rise once the phase transition temperature is achieved. While this temperature rise speeds up the phase transition rate, it also speeds up the decomposition of the material to form the molten materials that coat the surfaces. That is, there is no stabilisation of the particle temperature as is usual in strong endothermic reactions in non-isothermal systems. In many pyroprocessors the product quality is compromised by overheating of the particles above the desired temperature of the phase transition because such heating accelerates the fusion process. Because the phase transition is above the softening temperature of silica, there is a need for any pyroprocessor to minimise the residence time of particles in the pyroprocessor, and a need for that residence time to be about the same for all particles within the pyroprocessor. While fluidised beds are not impacted by flames, the attrition of the spodumene product particles in fluidised beds results in a dispersion of the residence time, and residence times in fluidised beds are generally longer than necessary. There is a need for a pyroprocessor that can maintain a temperature near the phase transition temperature, and which has a residence time of particles which is as short as possible to inhibit the growth of fused materials on the internal and external particle surfaces.

Any discussion of the prior art throughout the specification should in no way be considered as an admission that such prior art is widely known or forms part of common general knowledge in the field.

SUMMARY

Problems to be Solved

In the specific case of lithium extraction, the problem to be solved is the development of a pyroprocessing method for inducing the phase change α-spodumene to a mixture of β-spodumene and γ-spodumene which may be desirably (a) thermally efficient, (b) with a low residence time to minimise silica fouling on the particle surfaces, (c) with control of the temperature close to the phase transition temperature, (d) using particles with a size below about 200 microns, and (e) in a process that limits decrepitation and (f) in a process that allows the gas composition to be optimised if required.

It would be recognised by a person skilled in the art that the requirements for processing α-spodumene are generally common to many industrial applications of pyroprocessing in which there are benefits to controlling the process to improve the product quality, with heating rate, temperature and gas compositions being the primary variables.

The invention described herein may address at least one of the aforementioned problems that arise when undertaking pyroprocessing of materials.

Means for Solving the Problem

A first aspect of the present invention may relate to a method for heating a powder material to induce a crystalline phase change in the grains of the particle comprising the steps of: a. preheating the powder from the high temperature streams generated from cooling the phase changed product and or from any hot combustion gas stream in one or more heat exchangers; b. injecting the powder into a metal tube such that the velocity of the power flow is about 0.2 m/s throughout the tube; c. controlling the gas composition in the metal tube by injecting a gas into the reactor to displace gases that leak into the reactor and to displace gases that otherwise accumulate in the reactor; d. externally heating the first section of the tube by a first furnace segment system in which the temperature and power is distributed and controlled so that the falling powder is heated to the temperature at which the phase change commences in the grains of the particle; e. externally heating the second section of the tube by a second furnace segment system in which the temperature and power is distributed and controlled so that the phase change in the falling powder occurs at a temperature that allows the phase change in the grains of particle to be completed to the degree required during the drop of the powder through the length of this segment; f. quickly quenching the powder product temperature in a cold third segment of the tube; g. collecting the processed powder at the base of the tube in a bed ejecting the powder from the tube; h. cooling the powder in a heat exchanger and using the heat to preheat the powder in step (a).

Preferably, the degree of conversion is greater than 90%. More preferably, the degree of conversion is greater than 95%. Most preferably, the degree of conversion is greater than 99%.

Preferably, the reactor operates in the range of up to about 1150° C. by the use of high temperature steels.

Preferably, the tube has a variable diameter or with the segments therein are separated by powder beds.

Preferably, the residence time of the particles in the bed, and the bed temperature, is controlled so that a high degree of conversion can be met.

Preferably, the temperature and power system of the furnace segments firstly limits the temperature so that the stresses along the length of the hot metal tube limits the deformation and creep of the tube to give the tube a desirably long operational lifetime, and the temperature of the particle is maintained preferably just above the phase change temperature so that secondary decomposition reactions of the particle, if any, are suppressed.

Preferably, the process conditions are controlled such that the particles are not subject to internal stresses and collisions so that decrepitation of the particles as a result of the phase transitions or heating are suppressed to the extent that is desirable for subsequent processing.

Preferably, the furnace segments of the furnace segment system are combustor, and the fuel is renewable fuel such as biomass, or hydrogen.

Preferably, the furnace segments of the furnace segment system are electrical heating elements, and the electricity is produced from renewable sources such as wind, solar or hydro generators.

Preferably, the furnace segments of the furnace segment system are a combination of combustion segments and electrical heating elements.

Preferably, the method includes a pyroprocessor segment, in which the external furnace is a combustion system, or an array of combustion systems that provide the desired wall temperature distribution and power distribution required to accomplish the phase transformation as the powder falls through the reactor.

Preferably, the powder has a particle size distribution that is in the range of 5-300 microns. More preferably, the powder has a particle size distribution that is in range of 5-150 microns.

Preferably, an application of the method, the powder comprises α-spodumene and where the phase change occurs in the range of 500 to 1000° C. where the grains in the powder convert to a mixture of 3-spodumene and γ-spodumene, and the process conditions are set to maximise the efficiency of the process for extraction of lithium by (a) minimising the decomposition of the material in the powder into materials which fuses, and (b) minimising decrepitation of the product, and (c) minimising the temperature for energy efficiency by use of a reducing gas.

A pyroprocess is described by way of example, for the specific case of processing of α-spodumene, which is:—

(a) In a second aspect of the present disclosure, the pyroprocessor operates at a temperature, to induce the phase change of α-spodumene to a mixture of β-spodumene and the γ-spodumene. The pyroprocessor is designed to control the temperature of the particles to be close to temperature of the phase transition.

(b) In a third aspect of the present disclosure, the pyroprecessor processes particles with a particle size distribution that is most desirably produced by a separation process from gangue which has the highest separation efficiency of α-spodumene from the gangue of the mineral feedstock, and the prior art nominates this to be about 40-200 microns depending on the specific separation technique used;

(c). In a fourth aspect of the present disclosure, the pyropressor processes particles in a reducing or inert gas to accelerate the conversion of the γ-spodumene and to the β-spodumene, and to lower the temperature of the gas to directly produced the β-spodumene.

(d) In a fifth aspect of the present disclosure, the pyroprocessor operates with a residence time of less than about 60 seconds at a desired temperature;

(e) In a sixth aspect of the present disclosure, the pyroprocessor operates with a high thermal efficiency to minimise the operational costs;

(f) In a seventh aspect of the present disclosure, the pyroprocessor can operate on renewable power so that the process is sustainable to enable the production of batteries with a low emissions footprint, and which may operate in mining sites where the availability of combustion fuels is limited or is of high cost;

(f) In an eighth aspect of the present disclosure, the pyroprocessor can be scaled up to process minerals with a throughput that matches the desired production product to take advantage of the scale of production.

BRIEF DESCRIPTION OF THE FIGURES

Embodiments of the invention will be better understood and readily apparent to one of ordinary skill in the art from the following written description, by way of example only, and in conjunction with the drawings.

The embodiment of FIG. 1 illustrates a schematic of a system in which an externally heated vessel is used to pyroprocesses the feedstock so that both the wall temperature distribution and the gas composition can be controlled.

DESCRIPTION OF THE INVENTION

Preferred embodiments of the invention will now be described by reference to the accompanying drawings and non-limiting examples.

The Method of Pyroprocessing

The method of the invention described herein is an adaptation of the indirect heated calciner described by Horley and Sceats in WO2007112496 "System and Method of Calcination of Minerals" and references therein (incorporated herein by reference), and further developed Sceats et al. in WO2018076073 "A flash calciner" and references therein (incorporated herein by reference), where the adaptation in this invention is for the purposes of pyroprocessing of minerals, rather than calcination of minerals.

The need for a pyroprocessing reactor is illustrated by a typical example, where a calcination reaction may have an enthalpy of reaction of, say, 180 kJ/mol because bonds are broken, a pyroprocess may have an enthalpy of phase change of less than 10 kJ/mol. Most pyroprocessing reactors have been developed from traditional calciner designs, such as kilns, and perform relatively poorly compared to the invention described herein.

The example embodiments refer to the pyroprocessing of α-spodumene, which is one example of the application of this invention.

FIG. 1 is a pyroprocessor in which the mineral to be processed 101 is continuously injected by a feeder 102 into the top of a tubular reactor 103 which is heated externally by a furnace 104, and an injection of desired gas 105 is injected into the reactor near the base, and the pyroprocessed powder 106 is ejected from the base of the reactor, and the exhaust gas stream 107 is ejected from the top of the reactor. In this embodiment the pyroprocessor is separated into 3 segments A, B and C.

It would be appreciated by a person skilled in the art that the energy demand for the pyroprocess is minimised by preheating the power and gas by heat extracted from the exhausted powder 106 and exhausted gas 107, and any heat extracted from the furnace 104.

The difference with the calciner applications previously disclosed is that the reactor is not required to deal with large volumes of gas that that results from a calcination reaction of the mineral. The need to introduce a gas flow is to remove small volumes of gases that invariably leak into the calciner from the devices used to inject and exhaust powders, and for removal of any gases evolved from the powder such as moisture or from volatile impurities in the mineral, including those from floatation. It is desirable that such moisture and gases are removed in the preheating of the solids, where the preheating temperature is maintained below the temperature of the desired phase transition. Small volumes of gases may be introduced either in coflow or counterflow with the particles, and it may be preferable that the counterflow option is selected because the gas quenches the temperature of the pyroprocessed solids at the base of the reactor and preheates the powder at the top of the reactor.

Other reasons to inject small volumes of gas include (a) an ability to accelerate a phase change where the kinetics of the phase change is catalysed by a gas, such as steam or $CO_2$ and/or (b) where a control of the oxidation state of impurities or crystal defects is desired.

The heat is transferred into the reactor through steel, or other heat conductive materials, and the heat is absorbed by the gas and particles primarily by radiative heat transfer. Because the gas flow is preferably very low, the particles flow down the tube under gravity at about the terminal velocity of the particles in the nearly quiescent gas. The reactor diameter is typically the order of 2 m in diameter for a process flux of about 3 tonnes/hr/$m^2$.

The furnace is not dependent of the nature of the fuel used to provide the heat for the process, which may be from combustion of fossil fuels, waste materials, or desirably biomass, solar radiation or from the use of renewable power through electric elements that may be placed internally in the reactor. It is designed to provide heat to the powder to give effect to the segments A, B and C described below.

In this embodiment, the segment A at the top of the reactor is used to provide heat to the powder to a temperature above the phase change to activate that change, segment B is used to complete the phase change and segment C, if required, is used to extracted heat to flash quench the powder so that the reverse phase change does not have time to occur. The latter segment may be used in the case that the phase change is reversible.

The difference with the calciner applications previously disclosed is that the reactor is not required to deal with large volumes of gas that results from a calcination reaction of the mineral. The need to introduce a gas flow is to remove small volumes of gases that invariably leak into the calciner from the devices used to inject and exhaust powders, and for removal of any gases evolved from the powder such as moisture or from impurities in the mineral, or control a catalysis of a phase change, or inhibit the formation of eutectic phases. It is desirable that such moisture and gases are removed in the preheating of the solids, where the preheating temperature is maintained below the temperature of the desired phase transition.

The selection of the gas in determined by the nature of the mineral to be processed, and by the ability of the gas to absorb heat. The overall length of the reactor is determined by both the heat required to be transferred to the particles and the kinetics of the process. The residence time of the particles in the reactor is generally in the range of 10-60 seconds for pyroprocess, and the powder particles are in the range of 1-200 microns and is preferably matched to powder requirements used for separation processes such as floatation and the like.

The reactor length is typically in the range of 10-30 m to provide the residence time, and is primarily determined by the powder particle size, heat transfer rates and the kinetics of the desired phase change processes so as to achieve the desired degree of the phase change transformation, and to generally control the sintering of the processed mineral.

It is found that pyroprocesses are sensitive to the temperature distribution along the reactor wall, and control is important. This is associated with the low enthalpy of phase changes in most minerals compared to calcination reactions because the number of chemical bonds is not significantly changed, so that the settings of the reactor must be controlled with higher precision to enable the phase change to occur at the most desirable temperature, whereas in calcination reactions, the temperature within the particles is held within tight bounds by the endothermic load of the reaction. With control, the propensity of the temperature of the particle to rise substantially above the targeted phase transition temperature can push the particles towards entering reactions with impurities, such as those initiated by silica to form clinkers, eutectics, and undesirable phase changes of the minerals. It is desirable to have the control of the temperature to within ±5° C. to meet product specifications that are otherwise impaired. These requirements feed into the detailed design of the furnaces to control the heat transfer rate to maintain the particle temperature within a narrow band immediately after the temperature has reached the phase transition.

In the reactor of FIG. 1, the particle temperature first rises to the phase change temperature, and is then desirably pinned at the phase change temperature until the phase change is complete, and the temperature is rapidly quenched so as to prevent the particles reverting to the original phase. This requires not only the temperature of the reactor walls to be maintained with high precision, but also the design of the particle ejection system 106. The length scale over which a uniform temperature is required to be maintained is several meters.

To maintain a relatively uniform temperature of particles across the reactor, the design of the reactor is such that the diameter of the reactor tube is limited to be near the specification stated above. For large scale processing plants, a module of tubes may be used to achieve the desired throughput of the plant. In such a configuration, multiple tubes may be deployed in a single furnace.

It will be recognised by a person skilled in the art that modifications of the process flows of embodiment of FIG. 1 may be varied to account for other factors, such as fouling and environment emissions requirements.

It would be understood by a person skilled in the art that the design of pyroprocessors based on internal combustion, for example, from a flame in the centre of a reactor as used by the current systems used in pyroprocessing cannot give the temperature profile described above, with the precision described above, that is obtained using indirect heating. In such systems, a powder will typically experience a range of temperatures from the flame temperature of say, 1400° C. and that a range of 300° C. or more is typical.

The reactor design disclosed in this invention provides the desired control of temperature, is not adversely impacted by decrepitation, and the particle size is compatible with those obtained from flotation and required for lithium leaching. The particle size can be accommodated by the height of the reactor, and a large height for large particles can be offset by additional grinding before flotation where that process is used to remove gangue.

In consideration of the second aspect of the present disclosure with regard to temperature, the temperature of phase change can be set in an air environment to be about 1000° C. In the present invention of the pyroprocessor the pyroprocessor reactor has an array of furnace elements that provide heating for the reactant powder at the top of the steel tube to raise the temperature to that at which calcination can commence, and below that, the heating array provides the energy for calcination. An unexpected discovery is that the low enthalpy of a phase change is such that the wall temperature of the reactor requires only a small temperature above that of the phase change because the heat transfer rate into the particles is fast. In the indirectly heated pyroprocessor, FIG. 1 shows that the powder is injected at the top of the reactor, and the heat injection is intense to heat the particle up to the temperature of the phase change, and the length of the reactor below that has to be sufficient to allow the phase changes to occur, but now required very little demand for heat while avoiding a temperature rise which activates molten silica or formation of silicate eutectic coatings on the external surface and internal pores of the particle. The wall temperature can be controlled to maintain this, and the furnace power is distributed asymmetrically down the reactor. Further, the rapid quenching of the temperature can be achieved by a cold tube segment within the reactor, rapid ejection from the reactor by rotary valves, and the use of a plume heat exchanger as described by Sceats et. al. in AU 2019901169 or an air conveying system or cooled screw feeders.

A second advantage of the second aspect of the present invention arising from the external heating is that the product quality is not impaired by impurities in the combustion gas, such as bottom ash and fly ash. The absence of impurities such as CaO, MgO, $Al_2O_3$ and $SiO_2$ from the combustion of coal or biomass removes the clinkering reactions of these with silica in the spodumene phases, which fouls the surface of the product and may interfere with the subsequent lithium hydrothermal extraction processes. The separation of such combustion ash from the product lowers the production costs because the ash generally consumes the materials used to extract the lithium ion, and also may complicate the extraction process.

A third advantage of the second aspect of the present invention is that secondary milling of the particles to break up silica or silica eutectic coatings is not required.

In consideration of the third aspect of the present disclosure with respect to the particle size, in the present invention of the pyroprocessor, the particles flow down the reactor in a dilute solids fraction flow at a low velocity dictated by friction from the near-quiescent gas. Simply, there is no combustion gas that can entrain the particles, and this difference means that issues of entrainment are not relevant.

The powder gently falls through the reactor at a velocity of about 0.05-0.2 $ms^{-1}$ in a low solid fraction flow. The residence time is relatively uniform because the small particles form streamers around the larger particles to minimise the drag. The particle-particle collisions are infrequent and have a low momentum. In such a flow regime, the particles do not decrepitate by particle-particle collisions or particle-wall collisions so that the particle size distribution is almost unchanged from that of the input material. The advantage to this is that the product is easy to handle as a powder for the subsequent hydrothermal processing. This is particularly true of filtering and dewatering processes. Further, the cost of disposal of material that does not contain fines is lower. Thus the advantages of the reactor described in this invention is that the slow particle velocities and streamer formation allow for uniform degree of phase change, with little decrepitation that leads to lower cost of delithiation with an input of particle sizes that matches the most desirable size from efficient gangue separation.

In consideration of the sixth aspect of the present disclosure with respect to the reactor efficiency, the pyroprocessor operates with a high thermal efficiency. The efficiency of the pyroprocessor system is determined by the efficiency of the reactor and the ancillaries. If a combustor is used for the external heating, the flue gas from the furnace is used to preheat the combustion air, as is usual, and excess low grade heat may be used to remove moisture and preheat the powder. The heat in the powder exhaust may be used to further preheat the powder before injection into the reactor. The efficiency of the reactor segment is impacted solely by the radiative heat losses from the furnace segment, which is determined by the thickness and quality of the refractory. The efficiency of the heat exchangers for the air preheating and powder preheating are related to the capital costs. In the case in which electrical power is used to heat the steel as shown in the embodiment of FIG. 1, the only heat exchange required is the preheating of the input powder by the hot powder exhaust because the gas flow through the reactor is very small, and there is a transformer loss for converting the electrical power to heat. The efficiency of the pyroprocessor can be optimised by use of the best available heat transfer ancillaries. There no moving parts compared to rotary kilns that lead to large heat losses. The efficiencies may be in the range of 70-90%, and increases with the scaling up of the system by the use of modules. The efficiency enhancement is further enhanced by using the lower process temperature in a reducing atmosphere, by requiring a lower consumption of energy from the furnace to heat the walls.

In consideration of the seventh aspect of the present disclosure, the external heating may be from electrical elements. The efforts to limit $CO_2$ emissions, there has been the development of solar and wind power generators which have near zero emissions footprints, and because lithium batteries may be used to store electricity. The development of steels which can operate up to temperatures of about 1150° C. enables a design in which electrical power can be dissipated into heat by using the resistance of the metal to form the reactor steel, such that the heat is transferred directly to the powder in the reactor by radiative heat transfer. The alternative is to use such steels as electrical elements, so that heat is transferred through conventional high temperature steel. In another embodiment, the steel elements can be suspended in the reactor. In another example embodiment, the pyroprocessor may operate in a hybrid mode in which electric power is used to draw power from the grid to balance the grid power when renewable power is plentiful, and may switch to a combustion mode otherwise. In another embodiment, renewable power may be converted to hydrogen and oxygen and combusted in the furnace instead of fossil fuels. The core capability that enables these options is that the use of external heating, enabling the use of a wide variety of fuels, including electrical power, and combinations of these to provide the source of heat. In minerals processing, it is now feasible to generate renewable energy, and battery storage, close to the mine site so that many of the processes of beneficiation may be carried out at or near the mine in a continuous process.

In consideration of the eighth aspect of the present disclosure regarding scale up of production, it would be apparent that the processing of minerals in a single pyroprocessor pipe with a feed rate of about 3 tonnes/hr/$m^2$ into the pipe is such that multiple tubes are required to process sufficient material for processing minerals. There is a limit of about 2 m diameter of a tube that arises from the principles of radiation heat transfer and the penetration depth of radiation into a gas particle cloud. There are advantages in energy efficiency to scale up production using modules of tubes, where a module has preferably a small exposed surface area to limit radiation loss. Thus clusters of tubes in an array may suffice to provide a gain in efficiency, where the tubes may share the energy from a common furnace.

Another example embodiment is that the short residence time and the use of gases to control the atmosphere may be used by bypass slow phase changes or bypass reactions that would otherwise take place at a lower temperature. For example, the formation of CaO from limestone can be suppressed in a 1 bar reactor up to about 895° C. by using $CO_2$ as the gas and in this way, some clinkerisation reactions that would otherwise take place may be suppressed. In effect, the ability to use any gas in the reactor provides an additional degree of freedom for minerals pyroprocessing.

An Example of Pyroprocessing

Some of the benefits of the invention disclosed in this invention are considered by the application to the processing of α-spodumene for the extraction of lithium. There are three pyroprocessor designs currently used to calcine α-spodumene, with which this invention is compared; namely (a) a rotary kiln, (b) a flash calciner-suspension cyclone stack, and (c) fluidised bed.

These reactor designs are all internally heated reactors in which the gas is a flue gas from combustion. They have a need for excess air, so that the gas is say, 5% oxygen, 15% carbon dioxide, 10% steam and the remainder is nitrogen. This is an oxidising atmosphere. It will be shown below that the processing α-spodumene is benefitted by processing in a reducing atmosphere.

The rotary kiln and the flash calciner suspension cyclone stack operate the process using flames to heat the particles and when used to process α-spodumene the product is covered by a layer of silica and silicates that have formed because the particles see temperatures from the flames which are too high. For example, the desired phase transition temperature is 1000° C. for generating a mix of the low density β-spodumene and γ-spodumene phases, the particles will see a wide range of temperatures from the combustion temperature of 1400° C. to the refractory wall temperature of say 1000° C. The rotary kiln has a long residence time, typically of hours, and is particularly susceptible to such degradation. On the other hand, the flash calciner-suspension cyclone stack has a very short residence time of, say, 10 seconds, and to achieve the phase change in that time, the process temperature is increased above the phase transition temperature so that the unwanted reactions occur, and the product quality is degraded. It is found that the layers of silica/silicates carry a significant fraction of the lithium, up to about 15%, which cannot be extracted by the leaching processes. The economics of mineral extraction is strongly dependent on the degree of extraction, and many deposits are rendered non-viable by such a poor extraction efficiency. This is particularly true for the processing of α-spodumene.

In the fluidised bed, the temperature of the bed can be controlled, but small particles are rejected from the reactor by the combustion gas flow without a phase change as they heat up, and the propensity of the spodumene to decrepitate before the phase change in the particle is complete. Thus the process also has a deficiency in terms of the extraction efficiency. However, it is found that fluidised beds require large particle sizes, which are not compatible with the optimum particle size distribution from floatation process used before pyroprocessing, and with the leaching processes post pyroprocessing. While this issue can be addressed by additional processing steps, the cost of production increases and overall process is too expensive. Many deposits are rendered non-viable by the costs of the process. A characteristic of the pyro-processor described herein is that the optimum particle size is less than 200 microns because otherwise larger particles drop through the reactor too quickly to undergo the phase change for a pyroprocessor length preferably less than 20-30 metres. The particles size for the processing of α-spodumene is in the range of floatation separation. For example, the range of particles reported by Filippov et. al, in "Spodumene Floatation Mechanism" Minerals, 9, 372 (2019), are 80-150 microns in the top fraction and the bottom fraction is 40-80 microns. The bottom fraction is below the limit of pyroprocessing in fluidised beds. Both fractions can be processed in the invention described herein. Generally, the prior art for floatation of spodumene nominates the particles to be about 40-200 microns depending on the specific separation technique used, but many of these processes have been developed for fluidised beds.

In consideration of the fifth aspect of the present disclosure related to the powder residence time, in the present invention of the pyroprocessor, residence time is preferably 60 seconds or less. This residence time is determined by the criterion that the degree of phase conversion is as high as possible, preferably greater than 98% This residence time is determined by the time required to heat the input to the phase transition temperature at the top of the reactor, and for the completion of the phase transition in the remainder of the reactor. Too long a residence time, the length of the reactor become too long, so the temperature of the lower part of the reactor is set to achieve the conversion. There are two opposing factors that define this requirement in the lower part of the reactor. Firstly, the desire to maintain a low particle temperature to limit the formation of fused products and secondly the requirement to achieve a high degree of phase conversion. The trade-off is the length of this segment, which is desirably less than about 15-20 metres. The optimum diameter of the reactor tube is determined by the mass flow rate of about 3 tonnes/hr/$m^2$ and the need to provide uniform heating of the powder and the gas in the reactor. The diameter may vary to maintain a desirable heat transfer rate from the steel.

Further forms of the invention will be apparent from the description and drawings.

Although the invention has been described with reference to specific examples, it will be appreciated by those skilled in the art that the invention may be embodied in many other forms, in keeping with the broad principles and the spirit of the invention described herein.

The present invention and the described preferred embodiments specifically include at least one feature that is industrial applicable.

The invention claimed is:

1. A method for heating a powder material comprising α-spodumene to induce a crystalline phase change in grains of the powder material, the method comprising the sequential steps of a. preheating the powder material comprising α-spodumene in one or more heat exchangers using heat from high temperature streams generated from cooling a powder product and/or from any hot combustion gas streams;

b. injecting the preheated powder material into a metal tube such that the powder falls downwardly through the metal tube at a velocity of 0.2 m/s;

c. controlling a gas composition in the metal tube by injecting a gas into the metal tube near a base of the metal tube to displace gases that leak into the metal tube and to displace gases that otherwise accumulate in the metal tube;

d. externally heating a first section of the metal tube by a first furnace segment system in which a temperature and a power are distributed and controlled so that the powder falling through the first section is heated to a temperature at which the crystalline phase change commences in the grains of the powder, e. externally heating a second section of the metal tube by a second furnace segment system in which a temperature and a power are distributed and controlled so that the crystalline phase change in the powder falling through the second section occurs at a temperature that allows the phase change in the grains of the powder to be completed to a degree of phase-change required during the fall of the powder through the second section;

f. quenching a resultant powder product in a cold third section of the metal tube, thereby producing a quenched powder product;

g. collecting the quenched powder product at a base of the metal tube in a bed and ejecting the quenched powder product from the bed;

h. further cooling the ejected powder product in a heat exchanger and using the heat from the further cooled powder product to preheat the powder in step (a).

2. The method of claim 1, wherein the degree of phase-change is greater than 90%.

3. The method of claim 2, wherein the degree of phase-change is greater than 95%.

4. The method of claim 3, wherein the degree of phase-change is greater than 99%.

5. The method of claim 1, wherein the reactor metal tube operates in a range of up to about 1150° C. by a use of high temperature steels.

6. The method of claim 1, wherein the metal tube has a variable diameter or wherein the first section of the metal tube and the second section of the metal tube are separated by a powder bed, and the second section of the metal tube and the cold third section of the metal tube are separated by another powder bed.

7. The method of claim 1, wherein a residence time of the powder in the metal tube and the temperature of the first and the second furnace segment systems are each controlled to achieve a required degree of phase-change.

8. The method of claim 1, wherein the temperature and power of the first and the second furnace segment systems are distributed and controlled so that:

stresses along a length of the hot metal tube limit deformation and creep of the metal tube, and a temperature of the powder is maintained just above the phase change temperature so that secondary decomposition reactions of the powder, if any, are suppressed.

9. The method of claim 1, wherein the process conditions are controlled such that the powder is not subject to internal stresses and collisions so that decrepitation of the powder as a result of the phase transitions or heating is suppressed.

10. The method of claim 1, wherein the first and the second furnace segment systems are each combustors, and a fuel for the combustors is a renewable fuel including biomass or hydrogen.

11. The method of claim 1, wherein the first and the second furnace segment systems are each electrical heating elements, and the electricity is produced from renewable sources including wind, solar or hydro generators.

12. The method of claim 1, wherein the first and the second furnace segment systems are each a combination of combustors and electrical heating elements.

13. The method of claim 1, wherein the metal tube comprises a pyroprocessor in which the first and the second furnace segment systems are each a combustion system, or an array of combustion systems that provide a desired temperature and power distribution required to accomplish the phase change as the powder falls through the metal tube.

14. The method of claim 1, wherein the powder has a particle size distribution that is in a range of 5-300 microns.

15. The method of claim 14, wherein the powder has a particle size distribution that is in a range of 5-150 microns.

16. The method of claim 1, wherein the crystalline phase change occurs in a range of 500 to 1000° C. wherein the grains in the powder are converted to a mixture of β-spodumene and γ-spodumene, and wherein the process conditions are set to maximise the efficiency of a process for extraction of lithium by (a) minimising decomposition of the material into materials which fuse, and (b) minimising decrepitation of the product, and (c) minimising the phase-change temperature for energy efficiency by use of a reducing gas.

* * * * *